US008585052B2

(12) United States Patent
Hirata et al.

(10) Patent No.: US 8,585,052 B2
(45) Date of Patent: Nov. 19, 2013

(54) IMAGE FORMING APPARATUS

(75) Inventors: Fumihiko Hirata, Toride (JP); Yuji Yamanaka, Toride (JP); Taro Ikeda, Tokyo (JP); Kazuhiro Kosuga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 342 days.

(21) Appl. No.: 12/694,989

(22) Filed: Jan. 27, 2010

(65) Prior Publication Data

US 2010/0187746 A1 Jul. 29, 2010

(30) Foreign Application Priority Data

Jan. 28, 2009 (JP) ..... 2009-016215

(51) Int. Cl.
*B65H 7/02* (2006.01)

(52) U.S. Cl.
USPC ..... 271/259; 271/258.01; 271/258.02; 271/258.03; 271/265.02

(58) Field of Classification Search
USPC ..... 271/259, 262, 263, 258.01, 258.02, 271/258.03, 265.01, 265.02, 265.04, 301
See application file for complete search history.

(56) References Cited

U.S. PATENT DOCUMENTS 3,626,956 A * 12/1971 Sauder ..... 340/673
3,937,453 A * 2/1976 Hickey et al. ..... 271/4.09
4,307,957 A * 12/1981 Kitagawa et al. ..... 399/21
5,137,506 A * 8/1992 Haenel et al. ..... 493/417
5,280,322 A * 1/1994 Kono ..... 399/22
5,615,876 A * 4/1997 Yergenson et al. ..... 271/258.01
5,667,215 A * 9/1997 Yoshino ..... 271/258.01
6,402,133 B1 * 6/2002 Miyake ..... 271/3.19
6,802,504 B2 * 10/2004 DePoi et al. ..... 271/259
6,978,997 B2 * 12/2005 Able et al. ..... 271/258.01
7,386,964 B2 * 6/2008 Kuru et al. ..... 53/54
7,673,875 B2 * 3/2010 Motohashi et al. ..... 271/263
8,018,604 B2 * 9/2011 Murrell et al. ..... 358/1.12
8,025,290 B2 * 9/2011 Kajita ..... 271/259
2006/0006594 A1 * 1/2006 Kuru et al. ..... 271/258.02
2009/0051107 A1 * 2/2009 Muratani ..... 271/259

FOREIGN PATENT DOCUMENTS

JP 11-59969 3/1999
JP 2005-306503 11/2005

* cited by examiner

*Primary Examiner* — Prasad Gokhale
(74) *Attorney, Agent, or Firm* — Canon USA Inc. IP Division

(57) ABSTRACT

An image forming apparatus includes a sheet storage unit, a sheet feeding unit, a conveyance path for conveying a sheet to the image forming unit, a plurality of sheet detection sensors disposed along the conveyance path, a determination unit for determining whether predetermined time elapses from a detection of a front end of the sheet until a detection of a rear end of the sheet and a discharge unit. When the determination unit determines that the predetermined time has elapsed based on the detection by the sheet detection sensor disposed in the furthest upstream position among the plurality of sheet detection sensors, the sheet is discharged from the discharge unit, and when the determination unit determines that the predetermined time has elapsed based on the detection by the sheet detection sensors other than that disposed in the furthest upstream position, the sheet is stopped.

5 Claims, 8 Drawing Sheets

IMAGE FORMING APPARATUS

BACKGROUND OF THE INVENTION

1. Field of the Invention

The present invention relates to an image forming apparatus which includes a sheet feeding apparatus configured to feed a sheet individually from a sheet storage unit for storing sheets and a sheet conveyance unit configured to convey the sheet fed from the sheet feeding apparatus to an image forming unit.

2. Description of the Related Art

An image forming apparatus such as a copying machine, printer or multifunction peripheral is provided with a sheet feeding apparatus configured to feed a sheet individually from a sheet storage unit for storing sheets. Further, the image forming apparatus includes a sheet conveyance unit configured to convey sheets from the sheet feeding apparatus to an image forming unit. Currently there is an increasing demand for a reliable sheet conveyance unit which does not stop the apparatus due to jams (sheet blockage). However, at the same time, along with developments of colorization, there is a demand for increasing a sheet conveyance speed and for adaptation to a wide range of media, including media with coatings or thick paper having a grammage of at least 300 g/m2 and thin paper having a grammage of 60 g/m2 or less which tend to cause a double feed. Jams occurring in an image forming apparatus include a double feed in which a portion of a leading sheet overlaps and is fed with a next sheet, and sheet blockage in which a sheet is caught in a conveyance path or a conveyance roller.

An apparatus provided with a high-performance sheet feeding unit using an air-feeding method has been discussed to suppress a double feed by improving sheet separation performance. In the air-feeding method, air is blown from a side of stored sheets to raise and separate the sheets, and an uppermost sheet of the separated sheets is attached to a sheet feeding belt and conveyed.

A control method has been discussed in which a double feed detection sensor is provided in a sheet conveyance path of the sheet conveyance unit. Even when a sheet double feed occurs, the double fed sheets are discharged out of the conveyance path without stopping the apparatus due to a jam, so that sheet conveyance can be continued. This type of control method enables a reduction in a load on an operator who has to remove a jammed sheet or a sheet remaining in the apparatus and in downtime caused by stopping the image forming apparatus.

Japanese Patent Application Laid-Open No. 11-59969 discusses a control method which does not provide a double feed detection sensor in a sheet conveyance path but is configured to detect a load torque on a conveyance motor and a retention time and to determine whether jammed sheets can be discharged when a double feed or jams including sheet blockage occurs. Japanese Patent Application Laid-Open No. 2005-306503 discusses a method for separating sheets during conveyance when a double feed occurs in the sheet conveyance path. In this method, when the double fed sheets are gripped and conveyed by both upstream and downstream conveyance rollers, a rotation speed of the upstream conveyance roller is reduced to thereby separate the front sheet and rear sheet in the double feed.

A sheet feeding apparatus provided with a high-performance separation mechanism for suppressing a double feed of sheets includes a sheet feeding apparatus using an air-feeding method to separate sheets by blowing air from a side of a sheet stack as described above. Sheet jams may occur during a feeding operation even in the sheet feeding apparatus using such a method for preventing the sheet jam, albeit at a low frequency. The majority of jams during sheet feeding from the sheet feeding apparatus is the double feed. In the double feed of sheets, as described above, a front end of two or more sheets overlap with each other deviated in conveyance directions and are conveyed in a state that a conveyance length is longer than a single sheet. The double feed results when a next sheet is pulled from the sheet storage unit together with the separated sheet.

In the sheet feeding apparatus adopting the air-feeding method, a prevention measure against a double feed of sheets may include a double feed detection sensor provided downstream from the sheet feeding apparatus as described above to thereby detect a double feed of sheets during a feeding operation. However, installation of the double feed detection sensor which requires space and high-priced electrical components is not realistic in an image forming apparatus requiring economy of space and cost efficiency.

Even when a load torque on a motor is detected to determine whether a sheet can be discharged without using a double feed detection sensor, a determination based on the load torque is difficult in an image forming apparatus which handles various types of media including thin paper and thick paper. In other words, this technique is limited in application to specialized apparatuses such as those used for paper currency or image forming apparatuses which have a narrow range of applicable paper types.

The following problem is associated with a method for separating and conveying double fed sheets in the sheet conveyance path. When such a method is applied to an apparatus which can convey a plurality of types of sheets with different lengths in the conveyance direction, complicated conveyance operations and a long conveyance path are required to ensure separation when an deviation amount of double fed sheets is large or when the sheets are long. Consequently, application of such methods is restricted due to the increase in the size of the apparatus.

SUMMARY OF THE INVENTION

The present invention is directed to an image forming apparatus capable of using a simple mechanism to enable continuous sheet feeding without stopping the apparatus when sheets fed from a sheet feeding apparatus undergo a double feed.

According to an aspect of the present invention, an image forming apparatus includes a sheet storage unit configured to store a plurality of sheets, a sheet feeding unit configured to separate and feed sheets one by one from the sheet storage unit, a conveyance path configured to convey the sheet fed from the sheet feeding unit to an image forming unit, a plurality of sheet detection sensors which is disposed along the conveyance path and configured to detect a sheet being conveyed, a determination unit configured to determine whether predetermined time elapses from a detection of a front end of the sheet until a detection of a rear end of the sheet, and a discharge unit configured to discharge the sheet, wherein when the determination unit determines that the predetermined time has elapsed based on the detection by the sheet detection sensor disposed in a furthest upstream position among the plurality of sheet detection sensors, the sheet is discharged from the discharge unit, and when the determination unit determines that the predetermined time has elapsed based on the detection by the sheet detection sensors other than that disposed in the furthest upstream position, the sheet is stopped.

According to another aspect of the present invention, an image forming apparatus includes a sheet storage unit configured to store a plurality of sheets, a sheet feeding unit configured to separate and feed sheets one by one from the sheet storage unit, a conveyance path configured to convey the sheet fed from the sheet feeding unit, a plurality of sheet detection sensors which is disposed along the conveyance path and configured to detect a sheet being conveyed, a determination unit configured to determine whether predetermined time elapses a detection of a front end of the sheet until a detection of a rear end of the sheet, and an as cape unit configured to escape a sheet in the conveyance path to an outside the conveyance path when a sheet error occurs, wherein when the determination unit determines that the predetermined time has elapsed based on the detection by the sheet detection sensor disposed in a furthest upstream position among the plurality of sheet detection sensors, the escape unit escapes the sheet, and when the determination unit determines that the predetermined time has elapsed based on the detection by the sheet detection sensors other than that disposed in the furthest upstream position, the sheet is stopped.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
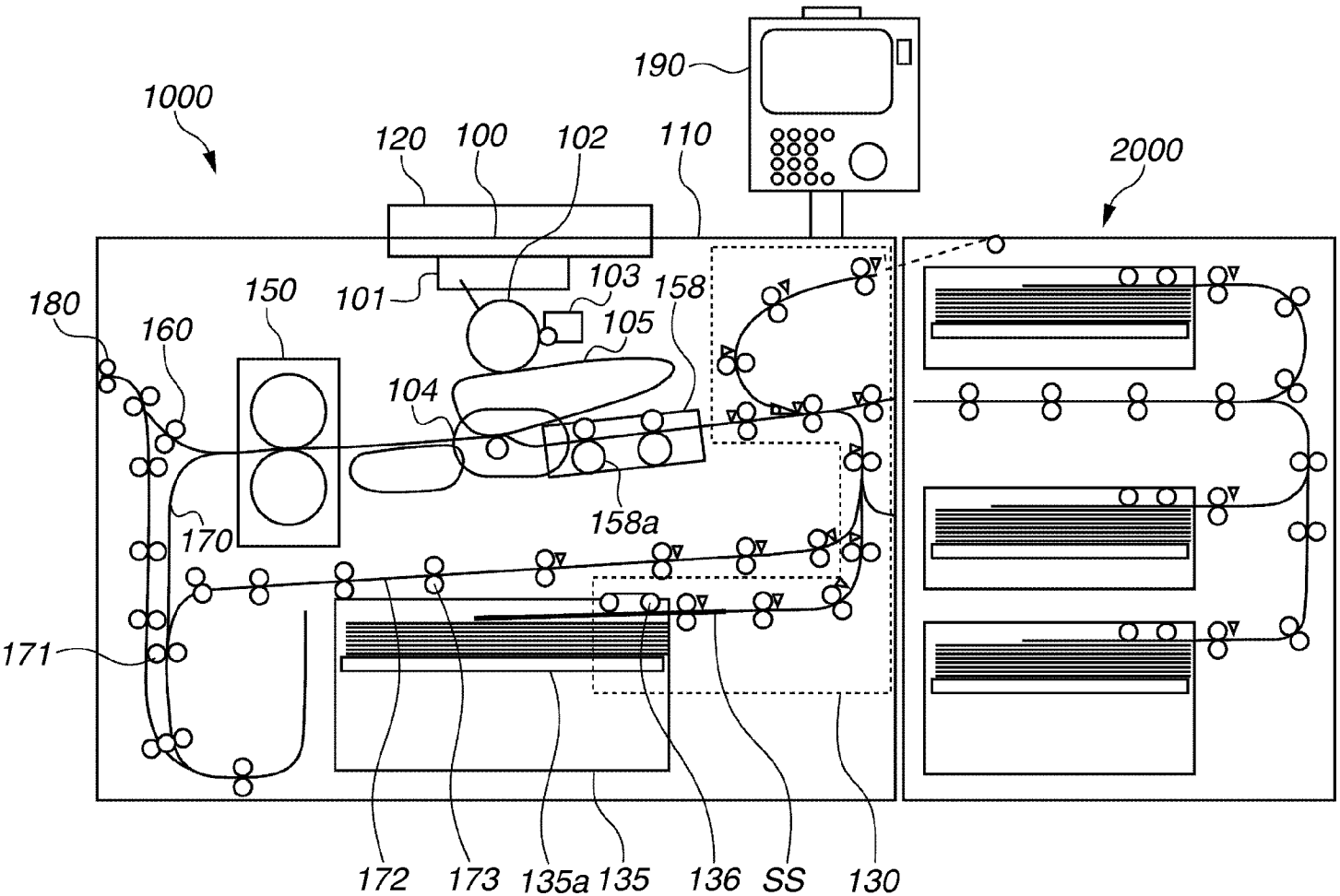
FIG. 1 illustrates a sectional view of an example of an image forming apparatus applying the present invention.

FIG. 1 illustrates a sectional view of an example of an image forming apparatus mounting a sheet conveyance unit according to the present invention. An image forming apparatus 1000 includes sheet storage units 135 which store a plurality of types of recording sheets and an image output apparatus (hereafter printer unit) 110 which outputs image data as a visible image on the recording sheet in accordance with a print command. The image forming apparatus 1000 is provided with a document feeding apparatus 120 which can continuously convey a document to a reading unit. An operation panel 190 includes a display unit for confirming required information such as settings for various modes or operating states. Details of operations are displayed on the display unit for user's perusal regarding errors including failure in sheet feeding. The image forming apparatus 1000 forms an image formation system by connection of the sheet storage unit 135, a sheet feeding unit 136, and an optional sheet feeding unit 2000 provided with a sheet conveyance unit to which the present invention is applied.

A tray 135*a* for stacking sheets is provided in the sheet feeding unit 136. A lifter drive motor B1 (illustrated in FIG. 2) can elevate the tray 135*a*, and a sheet feeding unit 136 can move the uppermost sheet to a feedable position. The sheet feeding unit 136 uses an air-feeding method which produces few double feed errors during feeding of various types of media sheets by separating sheets with air and attaching the sheet to a sheet feeding belt to convey it, so that the sheet can be separated and fed one by one. The sheet feeding belt is suitably driven by a sheet feeding belt drive motor B2 (illustrated in FIG. 2). However in addition to the air-feeding method, the sheet feeding unit 136 may use a sheet feeding unit which adopts a separation method using a general reversing roller or other separation methods.

Arrangement of the image formation system will be described based on a sequence of operations applied to a single sheet.

A document stacked on the document feeding apparatus 120 is sequentially conveyed sheet by sheet to a document glass platen (not shown) provided on an upper portion of the print unit 110. When the document is conveyed on the glass surface, an image is read by a scanner unit 100. The scanner unit 100 turns on a lamp and illuminate the document with the lamp by moving a scanner. Reflected light from the document passes via a mirror to a lens and is input to a portion of a charge-coupled device (CCD) image sensor (hereafter referred to as "CCD"). Input image information is photoelectrically converted in the CCD to an electrical signal. The electrical signal converted from the image information in the scanner unit 100 is subjected to various image processing and is input to the printer unit 110.

The signal input to the printer unit 100 may be not only input from an image input apparatus converting a document to image data but also a signal of image data sent from a personal computer or the like. The signal input to the printer unit 100 is converted to a light signal by an exposure control unit 101 to thereby enable illumination of a photosensitive drum 102 with laser light in accordance with the image signal. A latent image is produced on a surface of the photosensitive drum 102 by the illuminating laser light and the latent image is developed into a toner image by a developing unit 103.

On the other hand, a sheet is fed in sequence by the sheet feeding unit 136 from the sheet storage unit 135 which stacks sheets. The fed sheets are conveyed to a registration unit 158 by a sheet conveyance unit 130 which includes a plurality of conveyance rollers disposed along the sheet conveyance path.

A front end of the sheet conveyed to the registration unit 158 comes into contact with a nip portion of a registration roller pair 158*a*, so that skew in the sheet can be removed by making the front end of the sheet parallel to a rotational axis of the photosensitive drum 102. Thereafter, registration roller pair 158*a* is driven at a predetermined timing to align the conveyed sheet and a toner image formed on the photosensitive drum 102 on the transfer unit 104 and the toner image is transferred to the sheet.

The transfer unit 104 uses a drive roller and a driven roller to rotate an endless transfer belt 105 and a corona charging device (not shown) for transfer operations is disposed at a position roughly facing to the photosensitive drum 102 on an inner side of the transfer belt 105. This arrangement enables performance of transfer and conveyance with the sheet attached to the transfer belt 105.

The toner image transferred onto the sheet is fixed thereto by heat and pressure from a fixing unit 150. A cleaning member (not shown) for cleaning up a toner or paper dust abuts on the surface of the photosensitive drum 102 and the surface of the transfer belt 105 and both those surfaces are cleaned by the cleaning member. The sheet discharged from the fixing unit 150 passes through a discharge conveyance path 160 and is fed to a post-processing apparatus or a discharge paper tray (not shown) by a discharge roller 180.

When image formation is performed on both sides of a sheet, a sheet having a toner image fixed by the fixing unit 150 on a first surface is introduced to a reversing path 170 by switching a lever (not shown). When a rear end of the sheet comes to a position which is a predetermined distance downstream from the fixing unit 150, the sheet conveyance speed is increased. After the sheet is conveyed by a predetermined amount and when the rear end thereof comes to a position which is a predetermined distance upstream from the reversing roller 171, the reversing roller 171 is stopped. Thereafter, rotation of the reversing roller 171 is reversed to feed the sheet to a two-sided conveyance path 172 and then conveyed again to the registration roller pair 158*a* by a two-sided roller 173. In this manner, an image is formed on a second surface of the sheet on which image formation is not performed before. Then the sheet with an image formed on both the front and the rear surface passes through the discharge conveyance path 160 and is fed by a discharge paper roller 180 to a post-processing apparatus or discharge tray (not shown).

Figure 2:
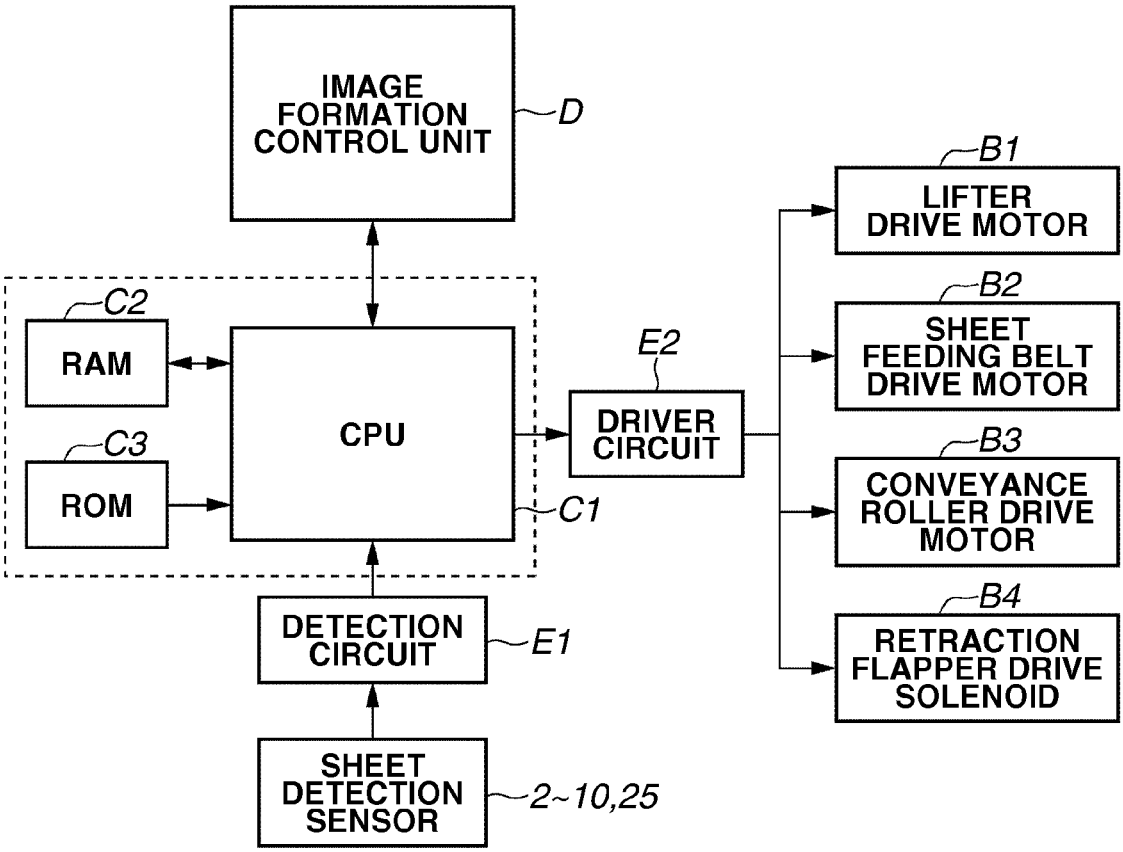
FIG. 2 is a block diagram illustrating a control system according to an exemplary embodiment of the present invention.

FIG. 2 illustrates a control block diagram of the sheet conveyance unit according to the exemplary embodiment of the present invention.

As illustrated in FIG. 2, a control unit C includes a central processing unit (CPU) (C1) which controls the overall sheet conveyance unit, a random access memory (RAM) (C2) which temporarily manages calculation data from the CPU, and a read only memory (ROM) (C3) which stores operation programs and determination data.

Sheet detection sensors 3 to 10 which transmit information from a sheet on the sheet conveyance path (illustrated in FIG. 3) and a sheet detection sensor 2 provided in proximity to the downstream side of the sheet feeding unit 136 are connected via a detection circuit E1. A lifter drive motor B1 which raises and lowers the sheet stacking tray of the sheet storage unit 135, a sheet feeding belt drive motor B2, a conveyance roller drive motor B3 and a drive solenoid B4 and are connected to the control unit C via a driver circuit E2. An image formation control unit D is connected to the control unit C, and a signal such as a feed timing is transmitted to the control unit C from the image formation control unit D, so that feeding and conveyance of the sheet are controlled.

Figure 3:
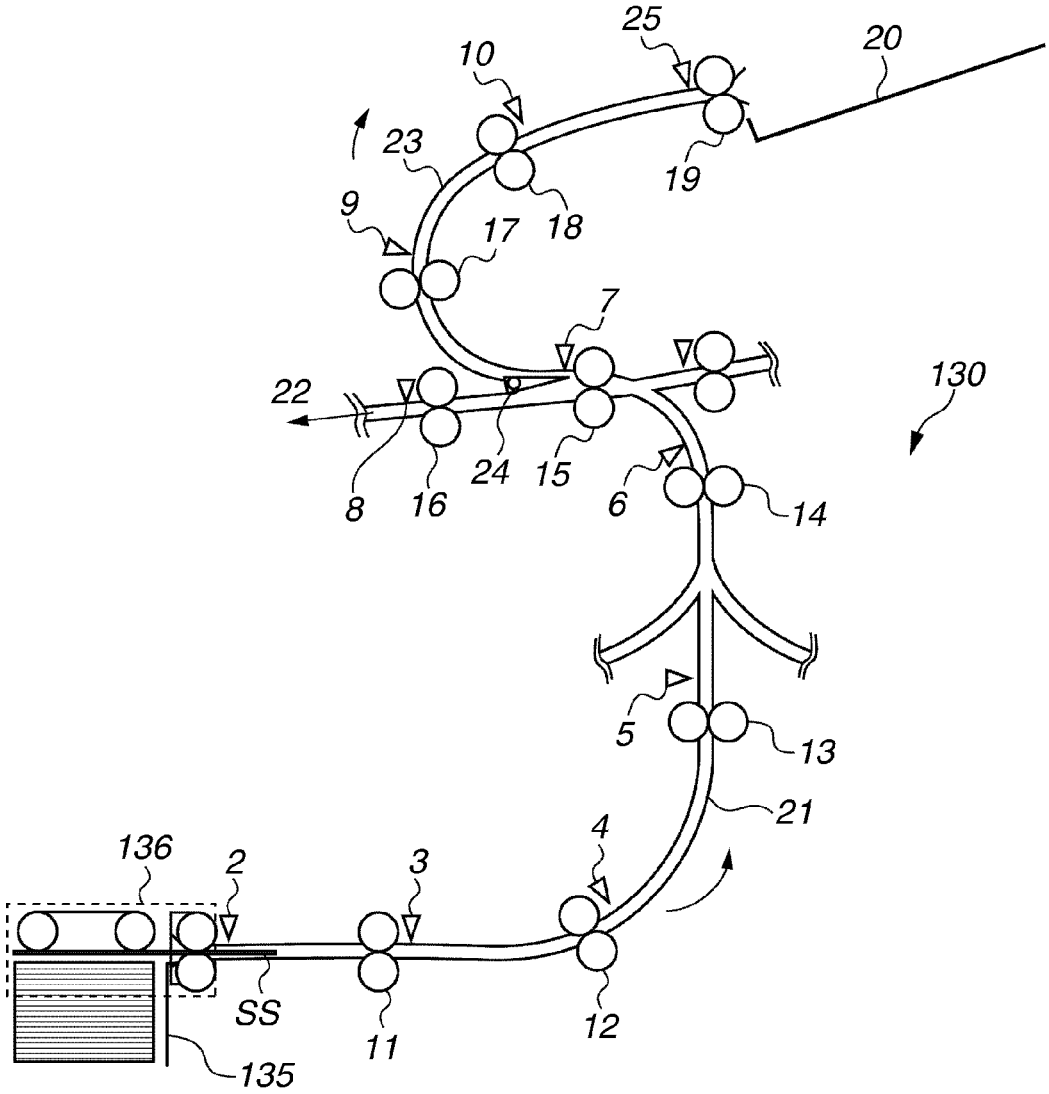
FIG. 3 is an enlarged diagram illustrating a sheet conveyance unit according to an exemplary embodiment of the present invention.

FIG. 3 is an enlarged diagram illustrating the sheet conveyance unit according to the exemplary embodiment of the present invention.

As illustrated in FIG. 3, the sheet conveyance unit 130 includes a conveyance path 21 which is formed by upper and lower guiding plates for guiding a sheet fed from the sheet storage unit 135 by the sheet feeding unit 136. The sheet detection sensor 2, conveyance rollers 11 to 16, and the sheet detection sensors 3 to 8 disposed in close downstream proximity to the respective conveyance rollers 11 to 16 are disposed in sequence from the sheet feeding unit 136 in the downstream sheet conveying direction of the conveyance path 21. The conveyance rollers 11 to 16 and escape rollers 17 to 19 described below are driven by the conveyance roller drive motor B3. Each sheet detection sensor detects a sheet during conveyance on the conveyance path 21.

An escape path 23 branches downstream of the conveyance roller 15 on the conveyance path 21. The sheet conveyance direction is switched by a switching member 24 provided in the branching portion and a sheet is fed to the conveyance path 22 towards the registration roller pair 158*a* or to the escape path 23 towards an escape tray 20, which is described below. The switching member 24 is rotated by the drive solenoid B4 to switch the conveyance path.

The escape rollers 17 to 19 which convey sheets and the sheet detection sensors 9 to 10, and 25 provided in close downstream proximity to the respective escapes rollers 17 to 19 are provided in the escape path 23. The escape tray 20 is provided downstream of the escape path 23 to discharge and stack escaped sheets. The sheet detection sensor 6 is provided upstream of the switching member 24 and functions as an escape sensor for determining an operating timing of the drive solenoid B4. Similarly, the sheet detection sensor 25 functions as a discharge sensor for confirming completion of discharge of a sheet to the escape tray 20. The escape unit according to the present invention is formed by the arrangement from the switching member 24 to the escape tray 20.

Figure 4:
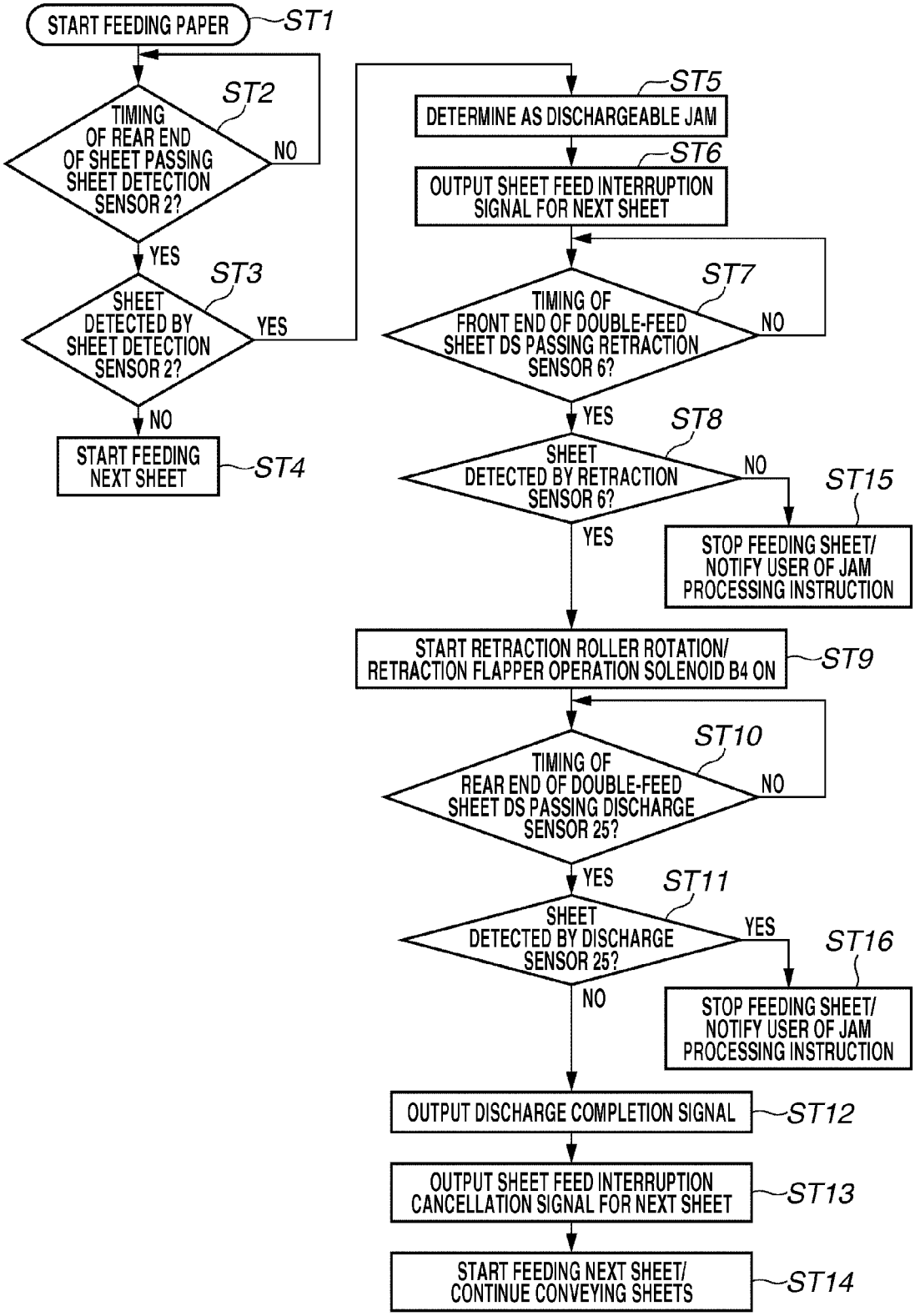
FIG. 4 illustrates a flowchart of operations according to an exemplary embodiment of the present invention.
Figure 5:
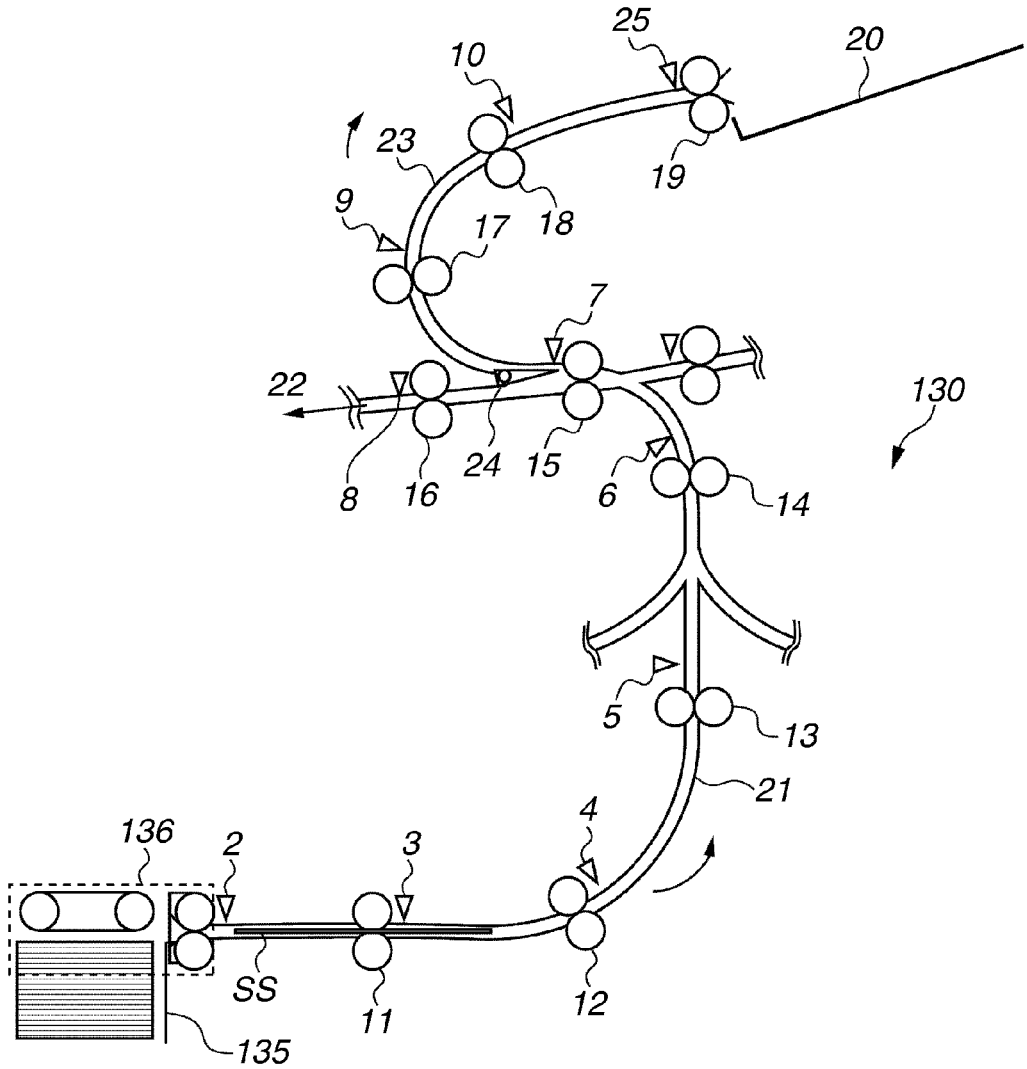
FIG. 5 illustrates a normal sheet conveyance state.

FIG. 4 illustrates a flowchart of operations executed by the sheet conveyance unit according to a first exemplary embodiment of the present invention. An operation flow will be described with reference to the flowchart in FIG. 4, FIG. 2, FIG. 5 and FIG. 8.

In step ST1, when a feed start signal is transmitted from the image formation control unit D to the sheet conveyance control unit C, sheet feeding is started. The RAM (C2) stores a conveyance length of a fed sheet SS by automatic detection or by a setting from a user. The CPU (C1) uses a relationship between the sheet conveyance length and the conveyance speed to predict time for the front end and rear end of the sheet SS to pass each sheet sensors 2 to 11.

In the present embodiment, in step ST2, a timer for a predetermined time from a start of rotation of the sheet feeding belt drive motor B2 to when the rear end of the sheet SS passes the sheet detection sensor 2 is set in the CPU (C1). The sheet detection sensor 2 is disposed the furthest upstream on the sheet conveyance unit 130 of the sheet detection sensors 2 to 10, and 25 and is the first sensor to detect a sheet fed from the sheet storage unit 135.

The above described predetermined time is set based on the time for the rear end of the sheet SS to pass the sheet detection sensor 2. In step ST3, when the predetermined time elapses, the presence or absence of the sheet SS is detected by the sheet detection sensor 2. Normally the sheet detection sensor 2 does not detect the sheet due to the state illustrated in FIG. 5. A detection signal which is output by the sheet detection sensor at this time is transmitted to the CPU (C1) via the detection circuit E1 and is determined as "no jam occurrence" (NO in step ST3).

Thus in step ST4, the sheet SS is conveyed from the conveyance path 21 along the conveyance path 22 and feeding of a next sheet is successively started. In the present exemplary embodiment, the CPU (C1) is a determination unit configured to determine whether predetermined time elapses from detection of the front end of the sheet by the sheet detection sensor to the detection of the rear end of the sheet.

Figure 6:
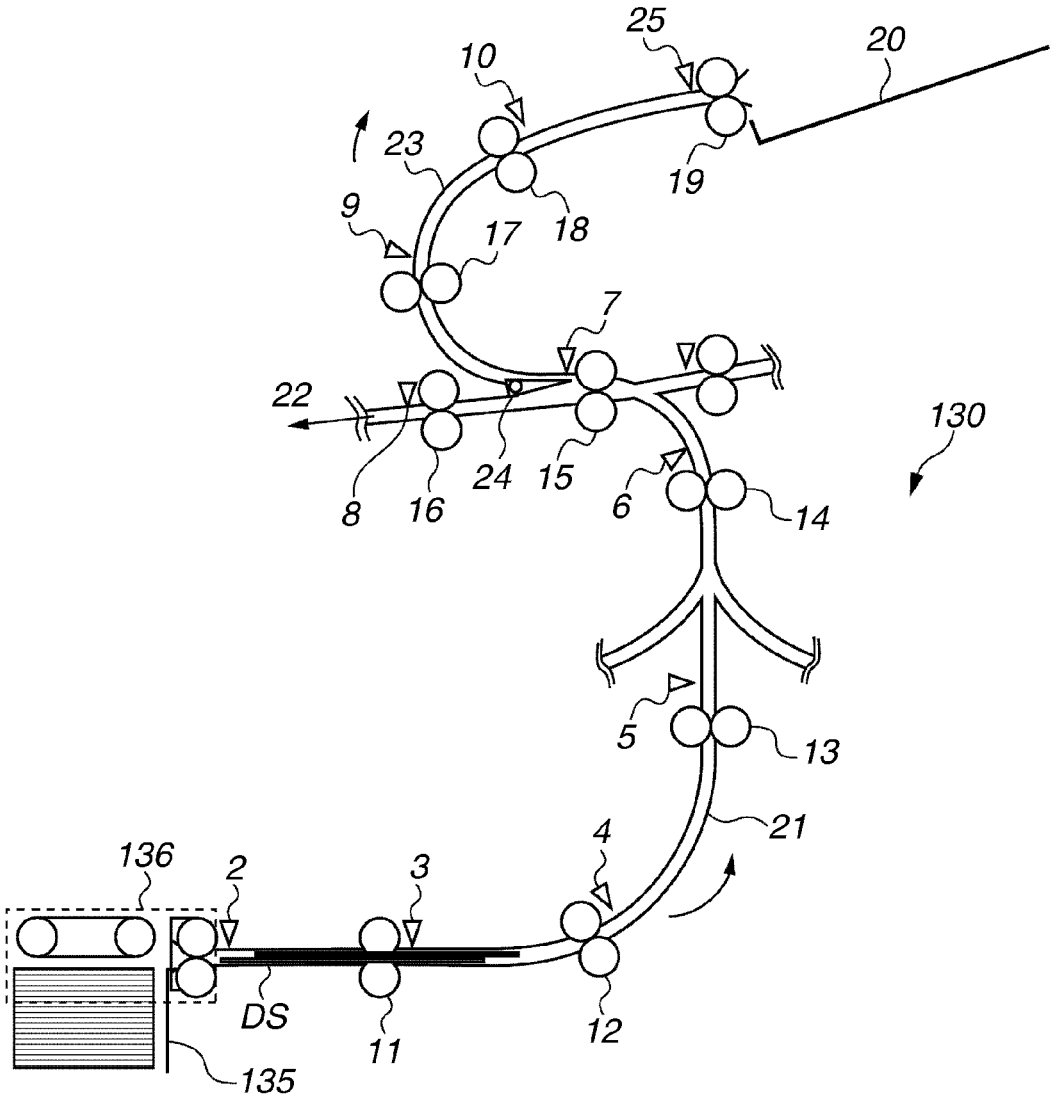
FIG. 6 illustrates a double feed sheet conveyance state (when a jam is determined).

However, when a double feed sheet DS is conveyed as illustrated in FIG. 6, even when the predetermined time has elapsed, a "sheet present" detection signal is output due to the detection of a sheet by the sheet detection sensor 2 (YES in step ST3). Then in step ST5, after receiving the signal, the CPU (C1) determines as a dischargeable jam.

In addition to the double feed sheet, a "sheet present" determination by the sheet detection sensor 2 may be made during the above detection timing when a sheet having a long conveyance size is fed, or when a jam or stoppage occurs due to a rotation failure of the conveyance roller or failure in the conveyance of the leading sheet.

However in the former, when the conveyance size is long, a determination as a "dischargeable jam" may be made in the same manner as a double feed. Furthermore a detection determination of "sheet present" will not be made if the sheet length is detected in advance in the sheet storage unit or the sheet length is entered by a user and the predetermined time is set in accordance with the sheet length.

In the latter, the occurrence of stoppage jams can be made effectively equal to zero simply by improving the reliability or durability of the conveyance roller or drive motor or by adapting the guide shape on the conveyance path. Thus during the above described detection timing, when the sheet detection sensor 2 disposed the furthest upstream among the sheet detection sensors 2 to 10, and 25 detects "sheet present", all such occurrences may be determined as a "dischargeable jam".

To avoid collision with the next sheet, in step ST6, a feeding interruption signal for the next sheet is output to the image formation control unit D from the sheet conveyance control unit C. On the other hand, the conveyance of the double feed sheet DS is performed in a downstream direction of the conveyance path 21 with a plurality of sheets overlapping. The time predicted for the front end of the double feed sheet DS to pass the escape sensor 6 is set in advance in the CPU (C1) based on the sheet conveyance speed. In step ST7 and step ST8, a detection signal from the escape sensor 6 is detected after the time has elapsed.

Figure 7:
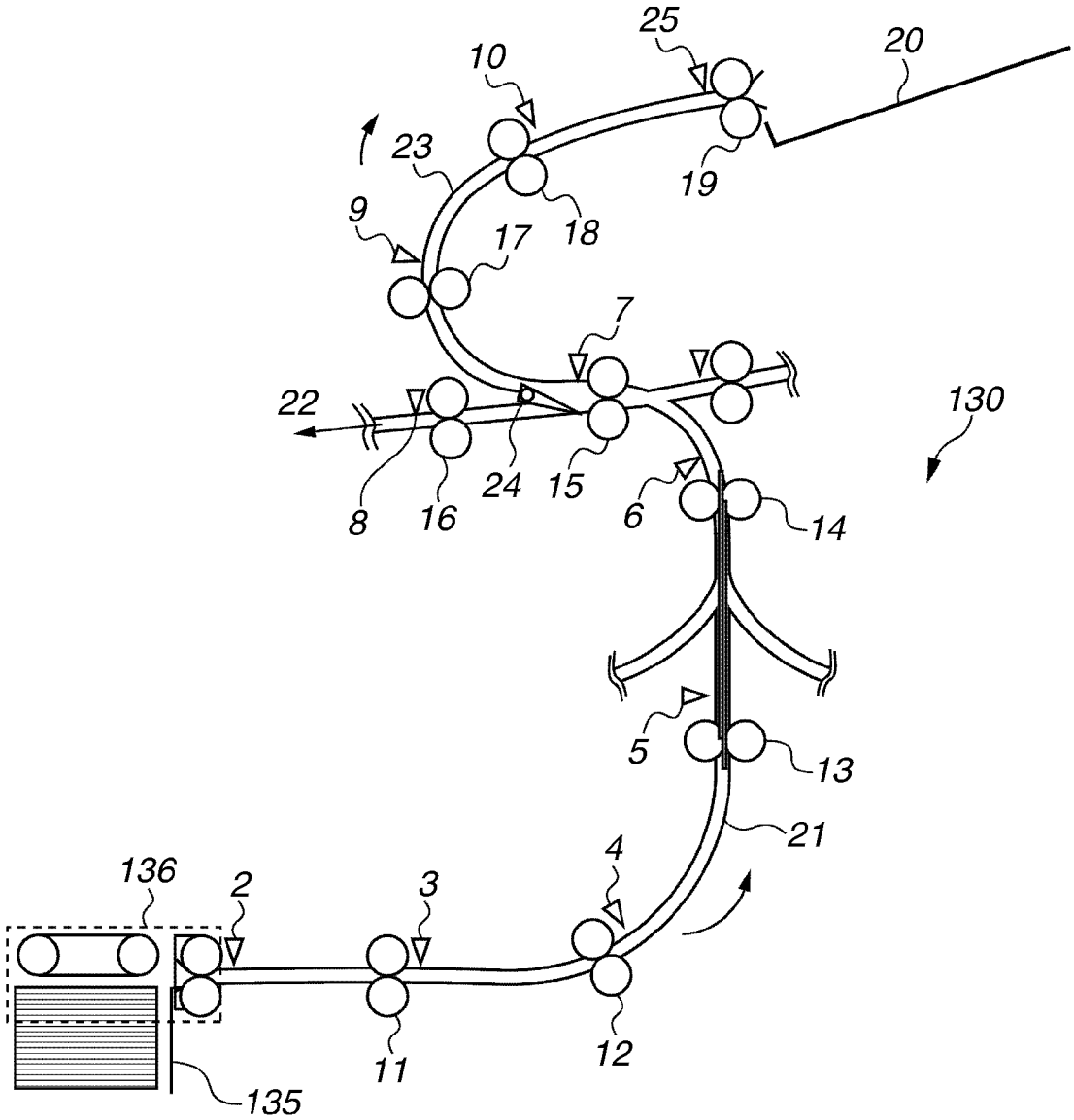
FIG. 7 illustrates a double feed sheet conveyance state (during escape conveyance of a double feed sheet).

When the detection signal from the escape sensor 6 is transmitted to the CPU (C1) and there is no problem in conveying the double feed sheet DS, "sheet present" is detected as shown in FIG. 7. In this case, the drive solenoid B4 is driven and the switching member 24 is switched so that the conveyance path shifts from the normal conveyance path 22 to the escape path 23. At the same time, in step ST9, the conveyance roller drive motor B3 which drives the escape rollers 17 to 19 of the escape path 23 is rotated. The double feed sheet DS is thus introduced into the escape path 23 and discharged onto the escape tray 20.

When the detection signal from the escape sensor 6 is "no sheet" (NO in step ST8), it is assumed that there is a problem that conveyance of the double feed jam DS cannot be continued. In this case, in step ST15, the apparatus is stopped, and a display to instruct a user to process (remove) the double feed sheet DS is output on the operation panel 190.

The description will now return to processing when the double feed sheet DS is introduced into the escape path 23. In step ST10, the time for the rear end of the double feed sheet DS to pass the sheet detection sensor 25 can be predicted from the time for the front end of the double feed sheet DS to pass the sheet detection sensor 25 of the escape path 23. However, the conveyance length of the double feed sheet DS differs according to a degree of variation and therefore the time is calculated based on the maximum conveyance length calculated from the maximum assumed amount of variation.

Figure 8:
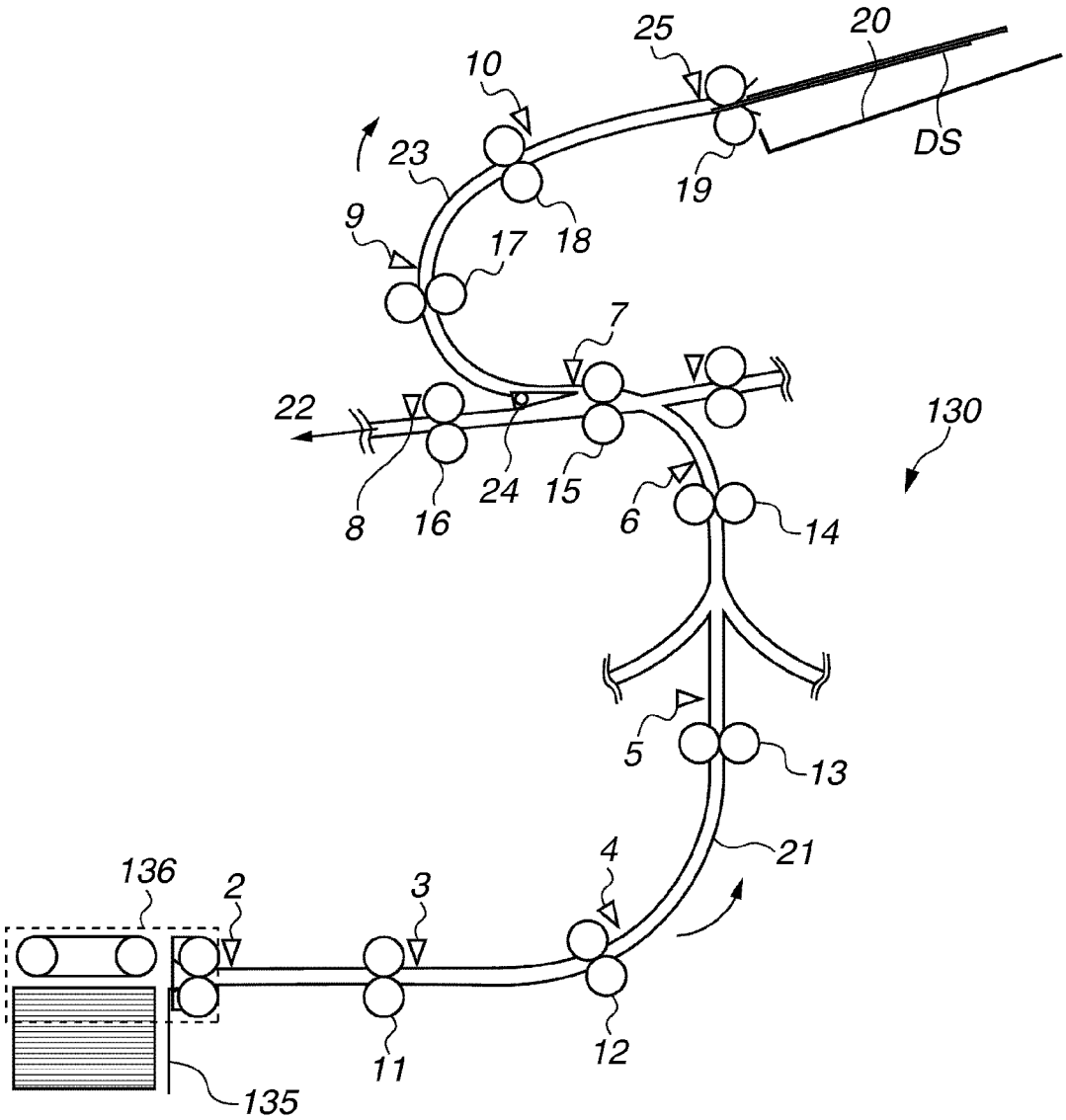
FIG. 8 illustrates a double feed sheet conveyance state (during discharge of a double feed sheet).

In step ST11, when "no sheet" is detected at the time same by the sheet detection sensor 25 as illustrated in FIG. 8 (NO in step ST11), the sheet conveyance control unit C determines that discharge of the double feed sheet DS to the escape tray 20 has been completed. Then in step ST12 and step ST13, the sheet conveyance control unit C outputs a discharge completion signal and a cancellation signal to cancel the feeding interruption of the next sheet to the image formation control unit D. Then a feeding signal for the next sheet is transmitted from the image formation control unit D to the sheet conveyance control unit C and feeding and conveyance of sheets are restarted.

When the sheet detection sensor 25 detects "sheet present" (YES in step ST10), the apparatus is stopped in the similar manner in step ST15 since it is determined that there is a problem with conveyance of the double feed sheet DS in the escape path 23. In step ST16, a display to instruct a user to process the double feed sheet DS is displayed.

The state described in steps ST15 and ST16 is desirable to be avoided as much as possible in the present exemplary embodiment. However, the occurrence of double feed sheet can be avoided by implementing the following configuration.

The conveyance rollers and the conveyance roller drive motor which can provide a conveyance force required for conveying double fed sheets from the conveyance path 21 to the escape path 23 are installed in the apparatus and a conveyance pressure appropriate therefor is used. The upper and lower guide plates forming the conveyance path may have low sliding resistance surface characteristics and a bending portion with a large round shape, and may be disposed with the sufficient upper and lower intervals. In this manner, the state in step ST15 and step ST16 can be avoided and when the sheet detection sensor 2 provided the most upstream among the sheet detection sensors detects "sheet present", all such occurrences can be determined as a "dischargeable jam".

In the present exemplary embodiment, the detection timing of the sheet detection sensor 2 is set as the timing of the passage of the rear end of the sheet SS. However, when sheets are actually conveyed, determination accuracy may be adversely affected by variation of the conveyance speed and errors in the sheet conveyance length, or variation in the detection of the sheet detection sensor 2 and the detection circuit E1.

Thus the time setting for the timer until the sheet detection sensor 2 starts detection can be made shorter than the predicted time. Then a plurality of signals detected in that short time interval is transmitted to the CPU (C1). The passage timing of the rear end of the sheet SS is accurately detected by the CPU (C1) based on the plurality of detection signals and the time from startup of the sheet feeding motor to the passage of the sheet may be compared with a predetermined time which is preset in the ROM (C3). The predetermined time used in the comparison is set by adding the sheet length, the conveyance speed, and detection variation to the time estimated using the conveyance length and the conveyance speed of the sheet SS.

Since the conveyance length differs from a normal sheet during escape conveyance of a double feed sheet DS, sheet conveyance control using the conveyance length by detecting the rear end of the sheet is not performed. Alternatively, conveyance control may be performed such that a new sheet conveyance length is calculated by accurately detecting the rear end passing timing using the sheet detection sensor 2 as described above, and it is not determined as a jam based on the new sheet conveyance length.

In the present exemplary embodiment, even when a double feed detection unit is not provided, double fed sheets can be discharged out of a normal conveyance path using an economic unit without stopping the apparatus due to a jam. Therefore, time that the apparatus is stopped until an operator completes the processing of the double feed sheet and time that the normal conveyance path is occupied by the double fed sheets can be reduced. In addition, a sheet in the double feed can be prevented from entering between sheets on which an image is normally formed.

Although the exemplary embodiment of the present invention is described above, the present invention is not limited to the exemplary embodiment. For example, although a double feed sheet is discharged into the escape tray 20 outside of the conveyance path in the above described exemplary embodiment, when the image forming apparatus is not provided with an as cape tray, the sheet may be passed through the image forming unit and discharged into a discharge tray as a discharge unit for stacking sheets on which images are formed. In this case, the double feed sheet in the image forming unit is conveyed without forming an image and the image scheduled to be formed on the double feed sheet is formed on the next sheet in the image forming unit. In this manner, continuous conveyance of sheets can be enabled.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-016215 filed Jan. 28, 2009, which is hereby incorporated by reference herein in its entirety.

What is claimed is:

1. An image forming apparatus comprising:

a sheet storage unit configured to store a plurality of sheets;

a sheet feeding unit configured to separate and feed sheets one by one from the sheet storage unit;

a conveyance path configured to convey the sheet fed from the sheet feeding unit to an image forming unit;

a discharge unit configured to discharge the sheet on which an image is formed by the image forming unit;

a plurality of sheet detection sensors which is disposed along the conveyance path and configured to detect a sheet being conveyed; and a control unit configured to determine whether predetermined time elapses from a detection of a front end of the sheet until a detection of a rear end of the sheet and to control a conveyance of the sheet, wherein, when the control unit determines that the predetermined time has elapsed based on the detection by the sheet detection sensor disposed in a furthest upstream position among the plurality of sheet detection sensors, the control unit controls the conveyance of the sheet so that the sheet detected by the sheet detection sensor of the furthest upstream position is discharged by the discharge unit through the image forming unit and controls the sheet feeding unit to feed a next sheet from the sheet storage unit, and when the control unit determines that the predetermined time has elapsed based on the detection by the sheet detection sensors other than that disposed in the furthest upstream position, the control unit controls the conveyance of the sheet so that the sheet is stopped.

2. The image forming apparatus according to claim 1, wherein, after the sheet is discharged to the discharged unit, conveyance of following sheet is continued based on determination by the control unit.

3. An image forming apparatus comprising:

a sheet storage unit configured to store a plurality of sheets;

a sheet feeding unit configured to separate and feed sheets one by one from the sheet storage unit;

a conveyance path configured to convey the sheet fed from the sheet feeding unit;

a plurality of sheet detection sensors which is disposed along the conveyance path and configured to detect a sheet being conveyed;

an escape unit configured to discharge a sheet in the conveyance path out of the image forming apparatus when a sheet error occurs; and a control unit configured to determine whether a predetermined time elapses from a detection of a front end of the sheet until a detection of a rear end of the sheet and to control the escape unit and a conveyance of the sheet, wherein when the control unit determines that the predetermined time has elapsed based on the detection by the sheet detection sensor disposed in a furthest upstream position among the plurality of sheet detection sensors, the control unit controls the escape unit so as to discharge the sheet detected by the sheet detection sensor of the furthest upstream position and controls the sheet feeding unit to feed a next sheet from the sheet storage unit, and when the control unit determines that the predetermined time has elapsed based on the detection by the sheet detection sensors other than that disposed in the furthest upstream position, the control unit controls the conveyance of the sheet so that the sheet is stopped.

4. The image forming apparatus according to claim 3, wherein, after the sheet is escaped to the outside the conveyance path by the escape unit, conveyance of following sheet is continued based on determination by the control unit.

5. The image forming apparatus according to claim 3, wherein the escape unit comprises an escape path branched on the conveyance path, a switching member provided in a branching portion of the escape path to switch a sheet conveyance direction and an escape tray provided downstream of the escape path to stack a discharged sheet, and when the control unit determines that the predetermined time has elapsed based on the detection by the sheet detection sensor disposed in the furthest upstream position, the sheet detected by the sheet detection sensor disposed in the furthest upstream position is discharged to the escape tray through the escape path.

* * * * *